United States Patent [19]

Moyer

[11] 3,968,641

[45] July 13, 1976

[54] DIGITAL WATCH WITH OSCILLATOR/DIVIDER POWER SELECTION CIRCUITRY

[75] Inventor: Norman E. Moyer, Newport Beach, Calif.

[73] Assignee: Hughes Aircraft Company, Culver City, Calif.

[22] Filed: May 12, 1975

[21] Appl. No.: 576,760

[52] U.S. Cl. ..... 58/50 R; 58/23 BA
[51] Int. Cl.[2] ..... G04C 3/00; G04B 19/30
[58] Field of Search ..... 58/23 R, 23 BA, 50 R

[56] References Cited

UNITED STATES PATENTS 3,911,665 10/1975 Berkum ..... 58/50 R

*Primary Examiner*—Edith Simmons Jackmon
*Attorney, Agent, or Firm*—Fay I. Konzem; W. H. MacAllister

[57] ABSTRACT

A digital watch with oscillator/divider power selection circuitry. The selection circuitry selects the source of the voltage to be supplied to the crystal oscillator and initial divider circuits. If battery voltage is low because battery current is high, as when the light emitting diodes (LED's) are illuminated in an LED digital watch or when the illumination light is on in a liquid crystal display (LCD) digital watch, the crystal oscillator and initial divider would be powered by two batteries; and when battery voltage is high because battery current is low, the crystal oscillator would be powered by only one battery. Therefore, the power selection circuitry determines whether one or two batteries are used to power the oscillator depending upon the particular operating conditions. There are two advantages of this technique: (1) current is reduced so battery life is increased, and (2) the voltage never goes so low that circuit production yields are adversely affected.

The power selection circuitry includes a plurality of metal oxide semiconductor field effect transistors (MOSFET's) and an input signal, which determines whether one battery is needed to power the oscillator because the LED's are not illuminated or two batteries are needed to power the oscillator because the LED's are illuminated.

7 Claims, 3 Drawing Figures

DIGITAL WATCH WITH OSCILLATOR/DIVIDER POWER SELECTION CIRCUITRY

BACKGROUND OF THE INVENTION

1. Field of the Invention

This invention relates to digital electronic watches, and more particularly to a digital watch having power selection circuitry for the oscillator and initial divider, which supplies power from only one battery when the battery voltage is high (current is low) and which supplies power from two series batteries when the battery voltage is low (current is high).

2. Description of the Prior Art

In the art, the LED digital watch and the liquid crystal display digital watch with an illumination light have employed two batteries (each supplying 1.5 volts) and a series resistor to power their oscillator/divider. Use of two batteries wasted power, i.e., only one battery, 1.5 volts, was needed when in the case of the LED digital watch, the LED display elements were not illuminated and in the case of the liquid crystal display digital watch when the illumination light was not lit. Such digital watches have been disclosed in application Ser. No. 515,797, filed Oct. 17, 1974, entitled "Digital Watch with Liquid Crystal Display," in patent application Ser. No. 558,183, filed Mar. 13, 1975, entitled "Digital Watch with Liquid Crystal and Light Emitting Diode Display" both of which are commonly assigned. The subject matter of these cross-references are incorporated herein in their entirety. A drawback with these digital watches is that two betteries and a resistor connected in series are being used to supply voltage to the oscillator/divider all of the time when the voltage from only one battery would be sufficient most of the time. This technique was used because one battery alone with a high load current only put out 1.2 V, which was so low that requiring operation at that voltage caused very low production yields. In order that 1.5 V be supplied during the short time that current was high, about 2.0 V was supplied the rest of the time. Current increases faster than supply voltage, so power was wasted by running at such a high voltage.

SUMMARY OF THE INVENTION

The power selection circuitry in a digital watch, in accordance with the invention, consists of a plurality of batteries connected in series and a plurality of switching means which connect varying numbers of batteries, depending upon the amount of voltage needed, to the oscillator/divider supply terminal. Typically only one battery is needed to power the crystal oscillator when the LED display elements are not illuminated. But the voltage from the series combination of two batteries, diminished by a series resistor, is needed when the LED display elements are illuminated.

Accordingly, it is an object of this invention to provide a power selection circuit in a digital watch which selects whether one battery, or two batteries in series are needed to power the crystal oscillator depending upon whether or not the batteries are carrying a high or low amount of current at the particular time.

It is a further object to provide power selection circuitry which increases the life of the batteries in a digital watch.

It is a further object to provide a circuit which uses only one battery to power the oscillator/divider when the LED display elements are not illuminated and which uses two batteries to power the oscillator/divider when the LED display elements are illuminated.

It is a further object to employ a power selection circuit which uses one battery to power the oscillator/divider of the digital watch when the illumination light in a liquid crystal display watch is off and to use two batteries when the illumination light is on.

The features of the present invention which are believed to be novel are set forth with particularity in the appended claims. The present invention, both as to its organization and manner of operation, together with further objects and advantages thereof, may be understood best by reference to the following description, taken in connection with the accompanying drawings.

DETAILED DESCRIPTION

Figure 1:
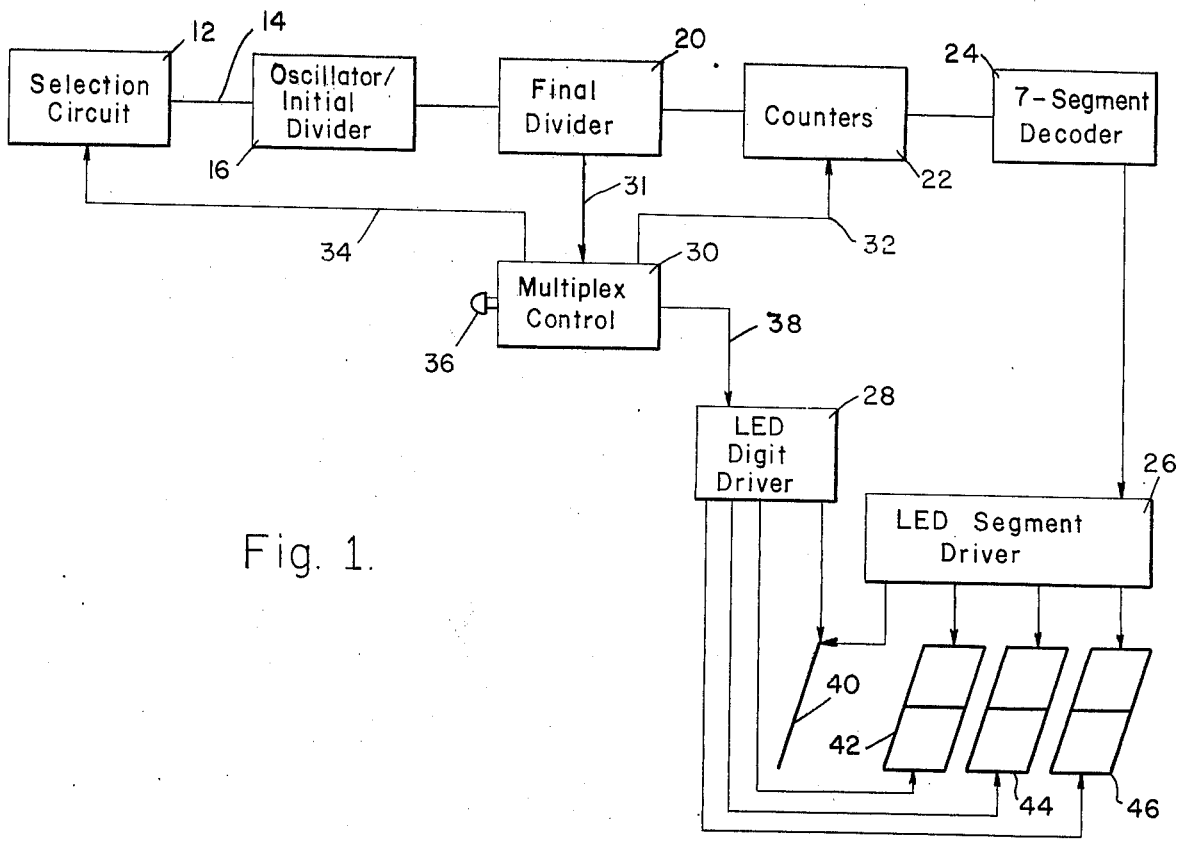
FIG. 1 is a block diagram of the circuitry of an LED digital watch.

Referring now to FIG. 1, the digital watch 10 includes power selection circuitry 12, which has output 14 to crystal oscillator/initial divider 16 and input 34 which is connected from multiplex control 30. The crystal oscillator oscillates at a predetermined and substantially constant frequency. The output from the oscillator/divider 16 is driven into another CMOS divider 20 which results in an output pulse of one cycle per second. This 1 Hertz pulse is then driven into a number of counters 22. The sequence of counters, which is described in patent application Ser. No. 515,797, filed Oct. 17, 1974, entitled "Digital Watch With Liquid Crystal Display," can be thought of as a consecutive chain of dividers from which various points in the divider chain may be tapped to produce the desired seconds, minutes, hours, and date outputs. All outputs from the counters 22 are standard binary coded decimal. Seven-segment decoder 25 is a device which receives the binary coded decimal signals from the counters 22 and outputs seven signals which correspond to the seven segments of the LED display devices so that, when turned on to be visibly distinctive, the segments represent the digits corresponding to the counter state.

Multiplex control 30 has an input 31 from the final divider and three outputs, lines 32, line 34, and lines 38. When a push button (e.g., 36) is depressed, multiplex control 30 signals through lines 32 the respective counters 22 to deliver their information through seven segment decoder 24 and the LED segment driver 26 to all the LED display elements 40, 42, 44, and 46. Also, multiplex control 30 signals through line 34 the power selection circuitry 12 to supply voltage from two batteries to oscillator/divider 16. Finally, multiplex control 30, through lines 38, allows illumination of LED characters in sequence in synchronism with data on lines 32 so that horological information is properly positioned. But when a push button is not depressed, and any timer to lengthen the display time has counted out, lines 38 prevent the LED digit drivers 28 from illuminating the LED display devices 40 through 46, and line 34 causes the oscillator/divider to receive power from one battery.

Figure 2:
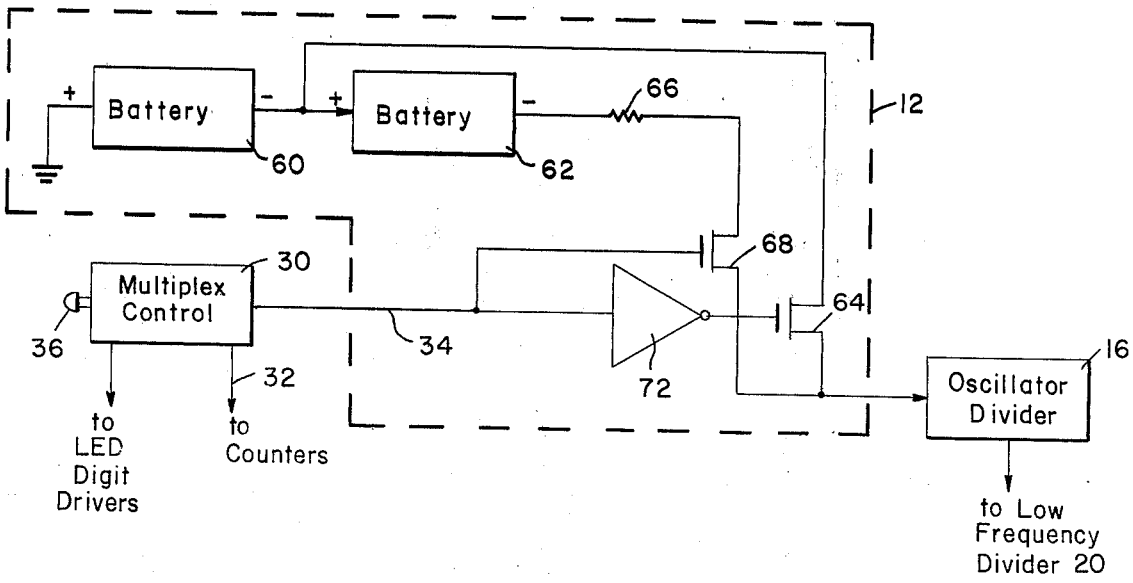
FIG. 2 is a schematic drawing of the power selection circuitry of the present invention.

FIG. 2 shows a detailed schematic of the power selection circuitry 12 of FIG. 1. The negative terminal of battery 60 is connected to the positive terminal of battery 62 and to N type MOSFET 64. The negative terminal of battery 62 is connected through resistor 66 to N type MOSFET 68. Resistor 66 is most easily included by suitable geometric sizing of MOSFET 68. The output of multiplex control 30 goes to the gate of MOSFET 68 and to the input of inverter 72. The source of MOSFET 64 is connected to the negative terminal of battery 60. The output of inverter 72 is connected to the gate of MOSFET 64, and the drains of MOSFET's 68 and 64 are both connected to the negative power terminal of oscillator/divider 16. All circuitry except the oscillator/divider is always powered by both batteries.

In operation, when all lights are off, a low or zero binary level signal is outputted via line 34 to MOSFET 68, turning if off. The low binary level via line 34 is also inputted into inverter 72 which outputs a high binary signal, and thereby allows MOSFET 64 to conduct delivering 1.5 volts to oscillator/divider 16.

When a light is on, multiplex control 30 delivers a high binary level signal to the gate of MOSFET 68 thereby allowing a higher voltage from the series combination of batteries and resistor to be delivered to oscillator/divider 16. Therefore, during low current conditions, only one battery 60 is used to power the oscillator/divider 16. But when high current is needed and battery voltage is thus reduced, the voltage from the two batteries 60 and 62 and a resistor 66 is used to power oscillator/divider 16. Another advantage of this circuit is evident here. Since MOSFET 64 is in a N-type well tied to one battery, the series combination of MOSFET 68 and resistor 66 cannot pull the output voltage more than 1 forward biased diode drop from the single battery voltage. This provides further regulation of the oscillator/divider supply voltage, and improves timekeeping stability and manufacturing yield.

Figure 3:
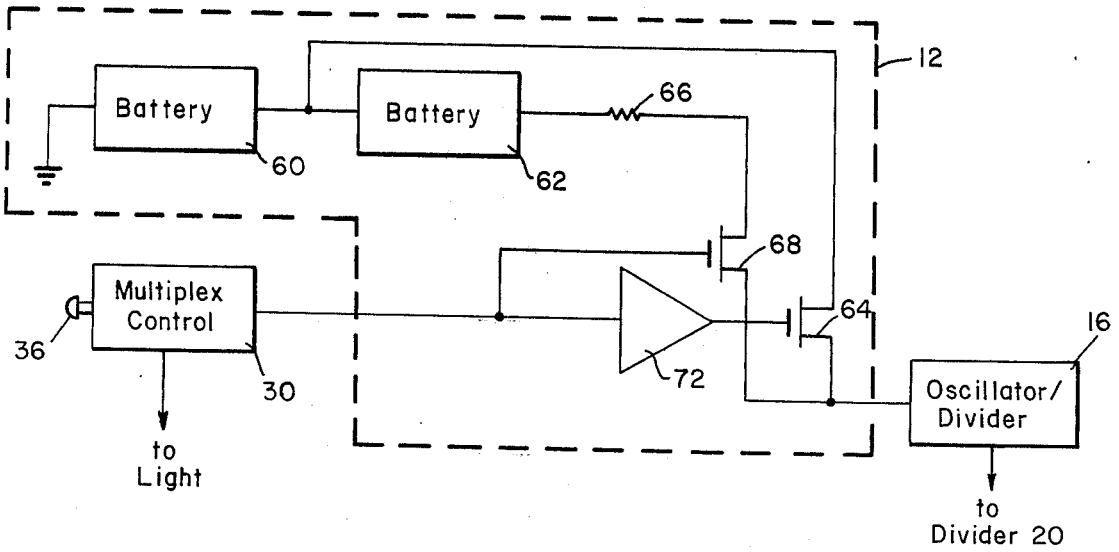
FIG. 3 is a schematic drawing of the battery powered selection circuitry for an illumination light in a liquid crystal display digital watch.

FIG. 3 shows a schematic drawing of the power selection circuitry in a liquid crystal display digital watch. This power selection circuitry works in the same way as that circuit of FIG. 2 except for the fact that when push button 36 is depressed, an incandescent light is turned on which is used in the liquid crystal watch to illuminate the liquid crystal numerals when insufficient ambient light is available.

Although the device which has just been described appears to afford the greatest advantages for implementing the invention, it will be understood that various modifications may be made thereto without going beyond the scope of the invention, it being possible to replace certain elements by other elements capable of fulfilling the same technical functions therein.

What is claimed is:

1. A method of increasing the battery life in an LED digital watch comprising a plurality of LED display elements, an oscillator divider and two series connected batteries, which comprises:

a. connecting only one of said battery to power the oscillator/divider when the LED display elements are not illuminated;

b. connecting said two series connected batteries to power the oscillator/divider when the LED display elements are illuminated.

2. A method of increasing the battery life in an LCD digital watch, with two batteries, an oscillator divider and an illumination light, which comprises:

a. connecting only one of said battery to power the oscillator/divider when the illumination light is not lit;

b. connecting said two series connected batteries to power the oscillator/divider when the illumination light is lit.

3. An improved digital watch of the type having two batteries, an oscillator/divider with a separate supply, a multiplexed LED display, a push button, and counters, wherein the improvement comprises:

said first and second batteries which are connected in series, each having an output;

an inverter having an input and an output;

said multiplex control being activated by said push button and having an output, said output being connected to said input of said inverter;

two MOSFET's having a gate, source and drain;

said gate of said first MOSFET being connected to the output of said inverter, said source of said first FET being connected to said output of said first battery, said drain of said first MOSFET being connected to said oscillator/divider supply terminal;

said gate of said second FET being connected to said output of said multiplex control, said source of said second FET being connected through a resistor to said output of said second battery, said drain of said second FET being connected to said oscillator/divider supply terminal;

when said LED display is on, said oscillator/divider is powered by said first and second batteries;

when said LED display is off, said oscillator/divider is powered by said first battery.

4. A power selection circuit in an LED digital watch having an oscillator divider, comprising:

a first and second battery connected in series, each having an output;

first means for connecting said first battery to the watch oscillator/divider to power said oscillator/divider when the LED display elements are not illuminated;

second means for connecting said output of said second battery to said oscillator/divider to power said oscillator divider when the LED display elements are illuminated.

5. A power selection circuit as recited in claim 4, wherein said first means is switching means connected between said first battery and said oscillator/divider supply terminal.

6. A battery power selection circuit as recited in claim 4, wherein said second means is switching means connected between said output of said second battery and said oscillator/divider supply terminal.

7. A power selection circuit in an LCD digital watch, with an illumination light for illuminating the liquid crystal display in dim ambient light an oscillator divider, comprising:

a first and second battery connected in series, each having an output;

first means for connecting said first battery to the oscillator/divider to power said oscillator/divider when the LCD digital watch's illumination light is not lit;

second means for connecting said output of said second battery to said oscillator/divider to power said oscillator/divider when the illumination light is lit.

* * * * *